US005125828A

United States Patent [19]

Browning

[11] Patent Number: 5,125,828

[45] Date of Patent: Jun. 30, 1992

[54] GRANITE FLAME FINISHING INTERNAL BURNER

[76] Inventor: James A. Browning, c/o Browning Engineering, P.O. Box A, Enfield, N.H. 03748

[21] Appl. No.: 670,834

[22] Filed: Mar. 18, 1991

[51] Int. Cl.[5] ..... F23R 3/00

[52] U.S. Cl. ..... 431/158; 431/157; 175/11; 175/14

[58] Field of Search ..... 431/158, 157; 175/11, 175/14

[56] References Cited

U.S. PATENT DOCUMENTS

| | | | |
|---|---|---|---|
| 2,882,016 | 4/1959 | Aitchison et al. | 175/14 |
| 3,255,802 | 6/1966 | Browning | 175/14 X |
| 3,463,249 | 8/1969 | Browning | 431/158 |
| 3,993,431 | 11/1976 | Oda et al. | 431/158 |
| 4,003,692 | 1/1977 | Moore | 431/158 |
| 4,204,831 | 5/1980 | Vanderveen | 431/158 |
| 4,342,551 | 8/1982 | Browning | 431/158 X |
| 4,830,604 | 5/1989 | Korenberg | 431/158 |

FOREIGN PATENT DOCUMENTS

| | | | |
|---|---|---|---|
| 998753 | 2/1983 | U.S.S.R. | 175/14 |
| 1506057 | 9/1989 | U.S.S.R. | 175/11 |

*Primary Examiner*—Larry Jones
*Attorney, Agent, or Firm*—Sughrue, Mion, Zinn, Macpeak & Seas

[57] ABSTRACT

An internal burner for producing a subsonic air-fuel flame jet capable of flame finishing granite of similar hard stone has a body forming a closed combustion chamber fed with an essentially stoichiometric flow of compressed air and fuel such that upon ignition and combustion of the reactants, there is produced at pressures in excess of 30 psig hot products of combustion. A first nozzle within the body of relatively small diameter $d_1$ at the exit end of the combustion chamber expands the products to supersonic velocity. A duct of sufficiently large diameter within the body downstream of the first nozzle and open thereto converts a jet of hot gases to subsonic velocity by shock action prior to discharging the hot gas products of combustion. A second nozzle having a large diameter $d_2$ in excess of the diameter $d_1$ of the first nozzle and open to the duct at the end opposite the first nozzle produces a subsonic flame jet to be directed against the rock surface.

4 Claims, 1 Drawing Sheet

GRANITE FLAME FINISHING INTERNAL BURNER

FIELD OF THE INVENTION

This invention concerns flame finishing of granite and similar heat-spallable stone which has become popular for producing rough surface finishes for structural and walkway purposes.

BACKGROUND OF THE INVENTION

In this field, a high-velocity, high-temperature flame is directed against the stone surface to produce spalls of individual as well as multiple grains.

Although oxy-fuel flames are often used for this purpose, their operating costs are high. Compressed air-fuel oil flames may also be used where the reactants are burned within an enclosed combustion chamber with the hot products of combustion expanding through a restricting nozzle to form a jet flame which is directed against the rock surface.

Such an air-fuel burner is described in my U.S. Pat. No. 3,211,242 issued July 23, 1963. Further, this patent discloses that maximum stone removal rates are associated with flame burners of the internal combustor type operating between 3 and 15 psig. Such pressures produce a high-velocity, but subsonic flame jet. Combustion at this low pressure level is difficult and requires large diameter burners to produce useful flows of hot gas.

SUMMARY OF THE INVENTION

The present invention produces the equivalent subsonic flame jets with a burner structure of much smaller size per unit of reactants burned. In essence, combustion takes place in a relatively small combustor volume at pressures between 50 psig and 100 psig depending on flame jet requirements and the available compressed pressure. The products of combustion expand through a small diameter nozzle through a pressure drop greater than critical into an enlarged passage for final discharge to the atmosphere at subsonic velocity.

BRIEF DESCRIPTION OF THE DRAWING

The single FIGURE is a longitudinal sectional view of a subsonic flame finishing internal burner forming a preferred embodiment of the invention.

DESCRIPTION OF THE PREFERRED EMBODIMENT

Figure 1:
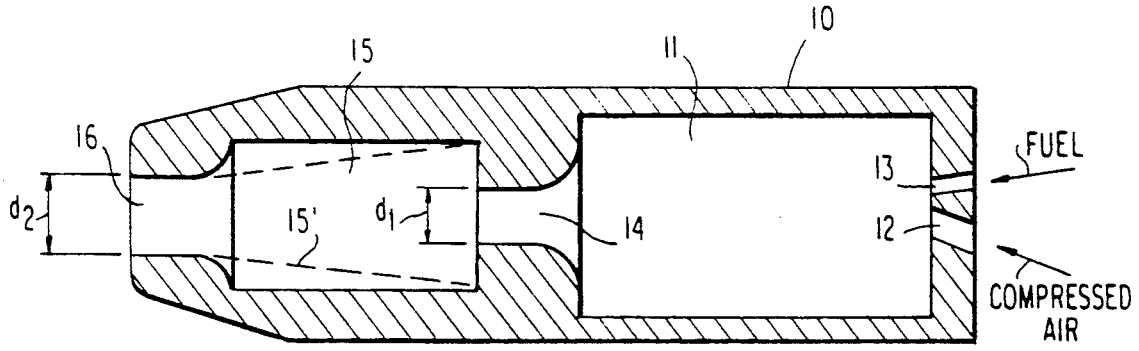

FIG. 1 discloses an internal burner from which one has ready understanding of the principles of the invention. A burner body 10 includes a closed combustion chamber 11 into which compressed air and fuel are injected via passages 12 and 13 respectively as indicated by the labeled arrows. Ignition is initiated within chamber 11 conventionally by a spark plug (not shown) or by backflash from the nozzle 16 exit whose bore diameter is $d_2$, larger than $d_1$. Combustion pressures may vary but are always maintained higher than 30 psig. Gases formed at high pressure during combustion expand through a first nozzle 14 at the outlet of chamber 11 having a bore of diameter $d_1$ into a downstream low pressure region producing a gas velocity greater than Mach 1. These gases in the form of a jet suddenly reduce their velocity to subsonic within downstream, radially enlarged chamber or duct 15 by shock action. The gases then pass through a second nozzle 16 at the exit end of chamber 15 with a pressure drop less than critical due to the diameter $d_2$ of the bore of nozzle 16. Duct 15 may be formed by a tapered wall 15' from first nozzle 14 to second nozzle 16, as indicated in dotted line fashion.

What is claimed is:

1. An internal burner for producing subsonic air-fuel flame jets for the flame finishing of granite and similar stone, said burner comprising a body forming a closed combustion chamber, means for feeding essentially stoichiometric flows of compressed air and fuel reactants to said closed combustion chamber, whereby upon ignition and combustion of said reactants within said combustion chamber at pressures in excess of 30 psig to produce hot products of combustion, a first nozzle within said body of relatively small diameter $d_1$ at an exit end of said combustion chamber to expand said products to supersonic velocity, a duct of sufficiently large diameter within said body downstream of said first nozzle and open thereto to convert the jet of hot gases to subsonic velocity by shock action for discharging hot gas product of combustion, and a second nozzle having a larger diameter $d_2$ than the diameter $d_1$ of said first nozzle within said body open to said duct and at the end of said duct opposite said first nozzle whereby a subsonic flame jet is produced to be directed against the rock surface.

2. The internal burner of claim 1, wherein said duct is an elongate duct having a diameter greater than that $d_2$ of the second nozzle, said duct being tapered and becoming smaller in the direction of an end thereof opposite the end open to said first nozzle, thereby forming said second nozzle.

3. The internal burner of claim 1, wherein the cross-sectional area of the second nozzle is more than 1.5 times that of the first nozzle.

4. The internal burner of claim 2, wherein the cross-sectional area of the second nozzle is more than 1.5 times that of the first nozzle.

* * * * *